US006637391B2

(12) United States Patent
Muraki et al.

(10) Patent No.: US 6,637,391 B2
(45) Date of Patent: Oct. 28, 2003

(54) CONTROL APPARATUS OF VARIABLE VALVE TIMING SYSTEM FOR INTERNAL COMBUSTION ENGINE

(75) Inventors: Hirotada Muraki, Brussels (BE); Masahiro Arai, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/157,011

(22) Filed: May 30, 2002

(65) Prior Publication Data

US 2002/0189563 A1 Dec. 19, 2002

(30) Foreign Application Priority Data

May 31, 2001 (JP) ..... 2001-164191

(51) Int. Cl.[7] ..... F01L 1/34

(52) U.S. Cl. ..... 123/90.17; 123/90.15; 123/90.16

(58) Field of Search ..... 123/90.15, 90.16, 123/90.17

(56) References Cited

U.S. PATENT DOCUMENTS 5,381,764 A * 1/1995 Fukuma et al. ..... 123/90.17

6,443,112 B1 * 9/2002 Kinugawa ..... 123/90.17

FOREIGN PATENT DOCUMENTS

| | | |
|---|---|---|
| JP | 10-153105 | 6/1998 |
| JP | 2000-45725 | 2/2000 |

* cited by examiner

*Primary Examiner*—Thomas Denion
*Assistant Examiner*—Jaime Corrigan
(74) *Attorney, Agent, or Firm*—Foley & Lardner

(57) ABSTRACT

In a variable valve timing system for an internal combustion engine, a soft-landing revertive control that an electromagnetic brake is de-energized and then an angular position of a camshaft relative to a crankshaft returns to an initial position is performed by a combination of a feedback control and a feedforward control. During the revertive control, the feedback control is executed in such a manner as to temporarily halt the angular phase of the camshaft at a predetermined position, which is phase-changed by a predetermined phase angle from the initial position. After the feedback control, the operating mode is switched to a feedforward control, so as to return the angular phase of the camshaft from the predetermined position to the initial position by changing a controlled quantity or a control-signal duty cycle value for the electromagnetic brake with a predetermined time rate of change.

20 Claims, 9 Drawing Sheets

CONTROL APPARATUS OF VARIABLE VALVE TIMING SYSTEM FOR INTERNAL COMBUSTION ENGINE

TECHNICAL FIELD

The present invention relates to a control apparatus of a variable valve timing system for an internal combustion engine, and particularly to techniques for controlling a rate of change in an angular phase of a camshaft relative to a crankshaft in a variable valve timing system capable of variably controlling an engine valve timing by varying the angular phase of the camshaft relative to the crankshaft.

BACKGROUND ART

A variable valve timing system generally uses a return spring for return to an initial position that there is no angular phase difference between the camshaft and the crankshaft. The initial position is determined by way of collision-contact with a stopper during the return to the initial position. For instance, in case of a hydraulically-operated variable valve timing system, in order to for the variable valve timing system to returning to its initial position, a variable valve timing controller (VTC controller) generates an inactive signal. Owing to the output of the inactive signal, the hydraulic pressure is released and thus the IVC system returns to the initial position. In this case, there is a time delay until the hydraulic pressure reduces to below a predetermined level. In other words, the returning speed to the initial position is slow. Such a slow return is often called "soft-landing". In contrast, in case of a variable valve timing system that uses an electromagnetic brake controlled by an electronic control module and capable of varying the angular phase of the camshaft to the crankshaft by way of friction brake, for return-to-initial-position, first, a VTC controller generates an inactive signal. The electromagnetic brake is deactivated, and thus the frictional braking force rapidly drops to zero. As a result, the VTC system returns to the initial position for a brief moment by way of the spring bias of the return spring. In this case, there is no problem of an undesirable slow return to the initial position. However, there is another problem of noises created by collision-contact with the stopper. One such variable valve timing system with an electromagnetic brake has been disclosed in Japanese Patent Provisional Publication No. 10-153105.

SUMMARY OF THE INVENTION

Accordingly, it is an object of the invention to provide a control apparatus of a variable valve timing system, which avoids the aforementioned disadvantages.

It is another object of the invention to provide a control apparatus of a variable valve timing system, which is capable of optimally controlling a rate of change in an angular phase of a camshaft relative to a crankshaft, for the same control condition, namely the same controlled range and the same control responsiveness, thereby reducing noises created by collision-contact with a stopper and ensuring the increased life of the stopper.

In order to accomplish the aforementioned and other objects of the present invention, a control apparatus of a variable valve timing system for an internal combustion engine, comprises a sensor that detects an angular phase of a camshaft relative to a crankshaft, a return spring that returns the angular phase of the camshaft to an initial position, and an electronic control unit configured to be electronically connected to the variable valve timing system to variably control a valve timing by changing the angular phase of the camshaft against a spring bias of the return spring and execute a revertive control by which the angular phase of the camshaft is returned to the initial position, the electronic control unit comprising a processor programmed to perform the following: (a) executing a feedback control that temporarily halts the angular phase of the camshaft at a predetermined position, which is phase-changed by a predetermined phase angle from the initial position, during the revertive control, and (b) switching to a feedforward control after the feedback control, so as to return the angular phase of the camshaft to the initial position.

According to another aspect of the invention, a variable valve timing system for an internal combustion engine comprises a sensor that detects an angular phase of a camshaft relative to a crankshaft, and an electronic control unit capable of performing a revertive control by which the angular phase of the camshaft is returned to an initial position with a specified control pattern, the electronic control unit comprising a processor programmed to perform the following: (a) switching an operating mode of the variable valve timing system from a feedback control to a feedforward control at a predetermined position, which is phase-changed by a predetermined phase angle from the initial position, during the revertive control.

According to a further aspect of the invention, a control apparatus of a variable valve timing system for an internal combustion engine, comprises a sensing means for detecting an angular phase of a camshaft relative to a crankshaft, a return spring for returning the angular phase of the camshaft to an initial position, and an electronic control unit configured to be electronically connected to the variable valve timing system to variably control a valve timing by changing the angular phase of the camshaft against a spring bias of the return spring and execute a revertive control by which the angular phase of the camshaft is returned to the initial position, the electronic control unit comprising (a) a feedback control means for executing a feedback control that temporarily halts the angular phase of the camshaft at a predetermined position, which is phase-changed by a predetermined phase angle from the initial position, during the revertive control that the angular phase of the camshaft is adjusted toward the predetermined position, and (b) a feedforward control means for initiating a feedforward control after the feedback control, so as to return the angular phase of the camshaft from the predetermined position to the initial position.

According to a still further aspect of the invention, a soft-landing revertive control method of returning an actual angular phase of a camshaft relative to a crankshaft to an initial position by controlling the actual angular phase of the camshaft in a variable valve timing system for an internal combustion engine, employing a return spring creating a spring bias acting in a direction that returns the actual angular phase of the camshaft to an initial position and an electromagnetic brake creating an electromagnetic force acting against the spring bias, the method comprises de-energizing the electromagnetic brake, calculating a target angular phase of the camshaft based on engine operating conditions, comparing the target angular phase to a predetermined position, which is phase-changed by a predetermined phase angle from the initial position, comparing the actual angular phase to the predetermined position, executing a feedback control that temporarily halts the actual angular phase of the camshaft at the predetermined position after the target angular phase reaches the predetermined position and the actual angular phase also reaches the predetermined position, and switching an operating mode of the variable valve timing system from the feedback control to a feedforward control after the feedback control has been continuously executed for a predetermined time period from a time when the actual angular phase has reached the predetermined position.

The other objects and features of this invention will become understood from the following description with reference to the accompanying drawings.

DESCRIPTION OF THE PREFERRED EMBODIMENTS

Figure 1B:
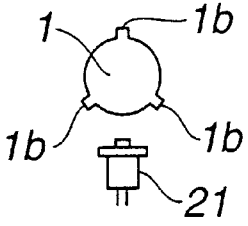
FIG. 1B is an axial view of the rear end of the VTC system of FIG. 1A, partly cross-sectioned.
Figure 1A:
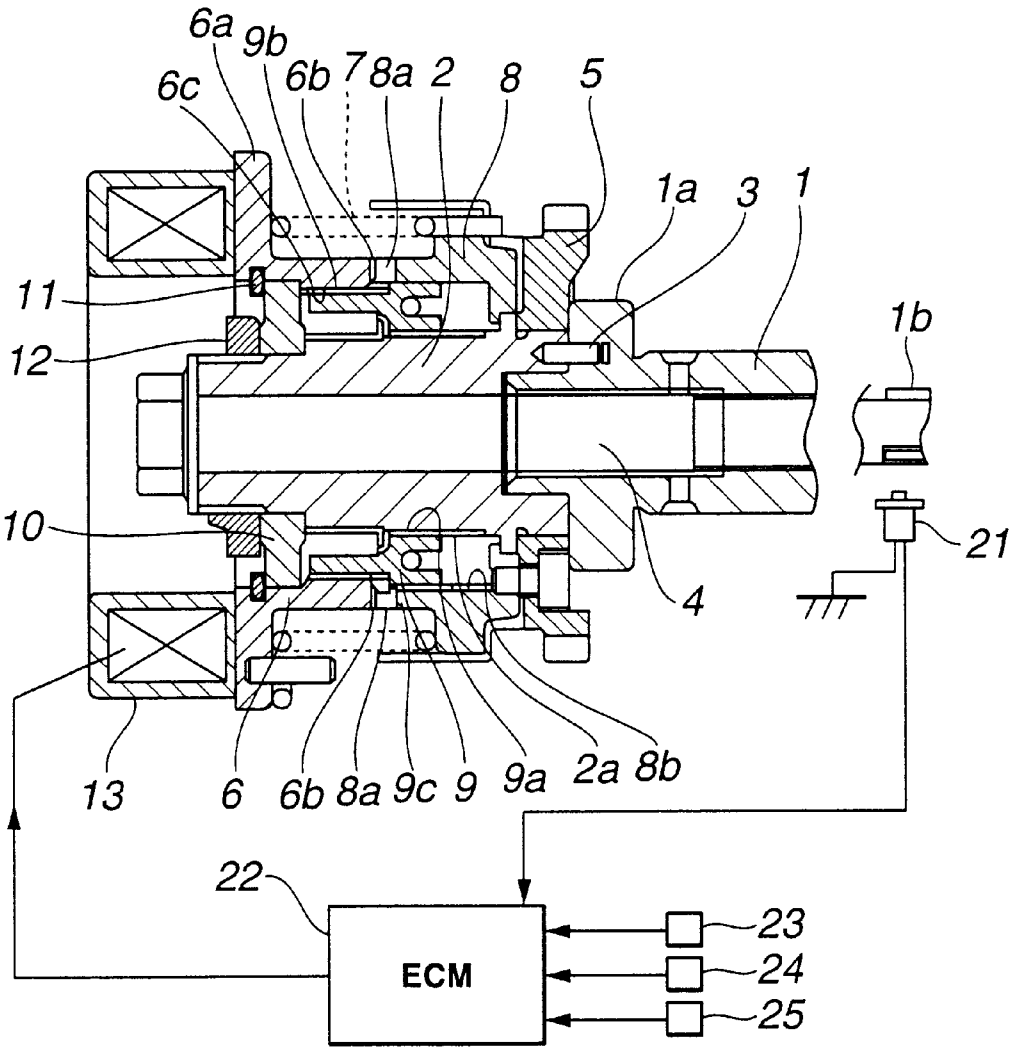
FIG. 1A is a longitudinal cross-sectional view showing a variable valve timing system (VTC system) to which a VTC controller (VTC control apparatus) of the embodiment is applied.
Figure 2:
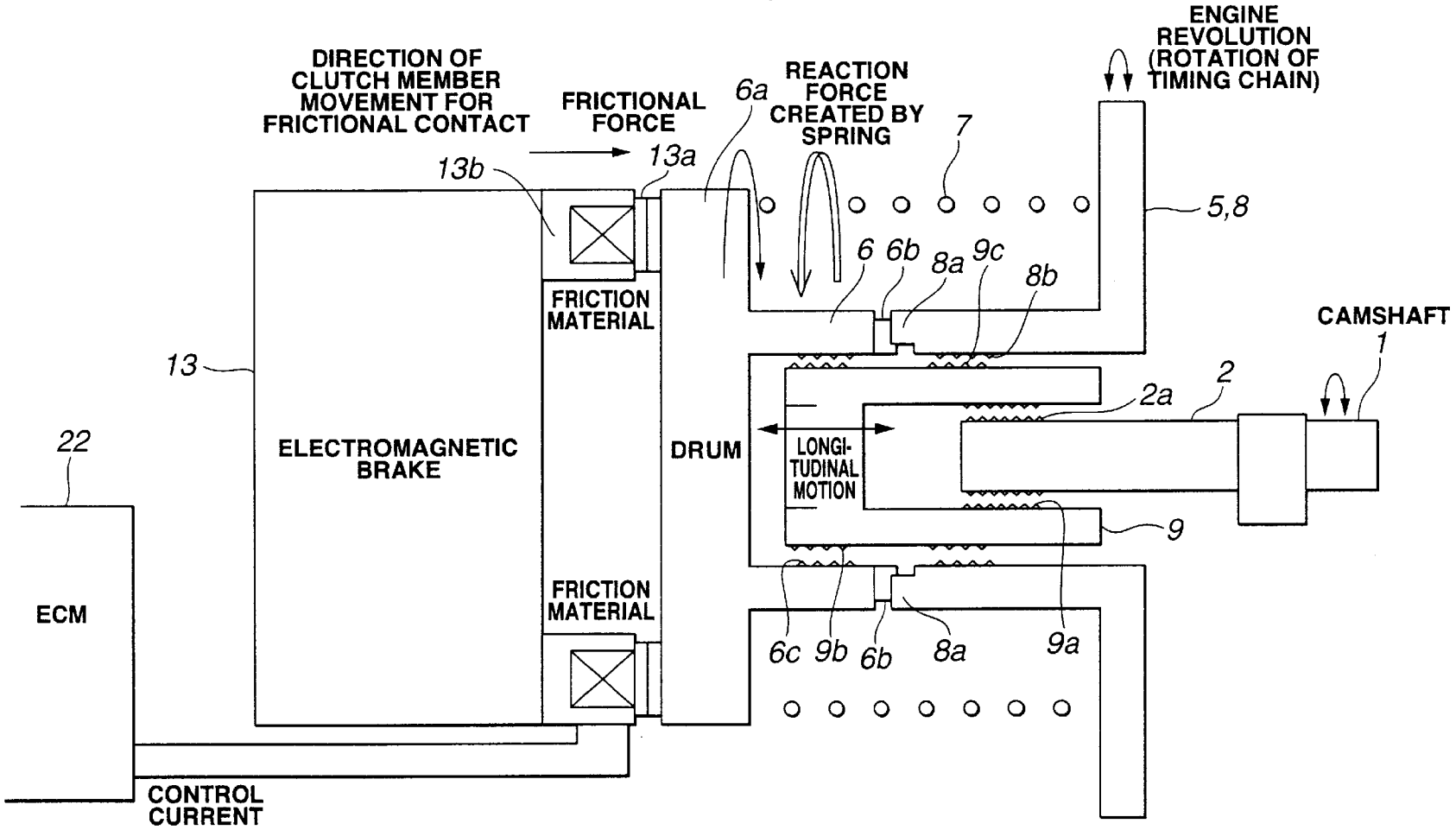
FIG. 2 is an explanatory view showing the operation of the VTC system of FIGS. 1A and 1B.

Referring now to the drawings, particularly to FIGS. 1A–1B, and 2, the variable valve timing (VTC) controller of the invention is exemplified in a variable valve timing system that uses an electromagnetic brake controlled by an electronic control unit or an electronic control module (ECM) and variably adjusts a valve timing of an intake valve. For the sake of simplicity in the following discussion, a variable valve timing system that variably adjusts a valve timing of an exhaust valve is omitted, because the actions and constructions are almost the same in variable valve timing systems for intake and exhaust valves. When comparing the variable exhaust-valve timing system to the variable intake-valve timing system, the phase-change direction (timing-change direction) of the variable exhaust-valve timing system is different from that of the variable intake-valve timing system.

As shown in FIG. 1A, a cylindrical motion transmission member 2 is fixedly connected to a camshaft end 1*a* of a camshaft 1 that is rotatably supported on an engine cylinder head (not shown). In more detail, relative rotation of motion transmission member 2 to camshaft end 1*a* is prevented by means of a knock pin 3 also serving as a positioning pin for motion transmission member 2 to camshaft end 1*a*. Under such a condition, motion transmission member 2 is securely connected to the camshaft end by means of a fastening bolt 4. A sprocket (exactly, a timing sprocket) 5 is rotatably supported on the outer periphery of motion transmission member 2, in such a manner as to permit relative rotation of sprocket 5 to camshaft 1. Sprocket 5 is rotated by way of a timing chain in synchronization with rotation of an engine crankshaft. Rotation of sprocket 5 is transmitted or input via a motion-transmission mechanism (described hereunder) to motion transmission member 2.

Figure 3:
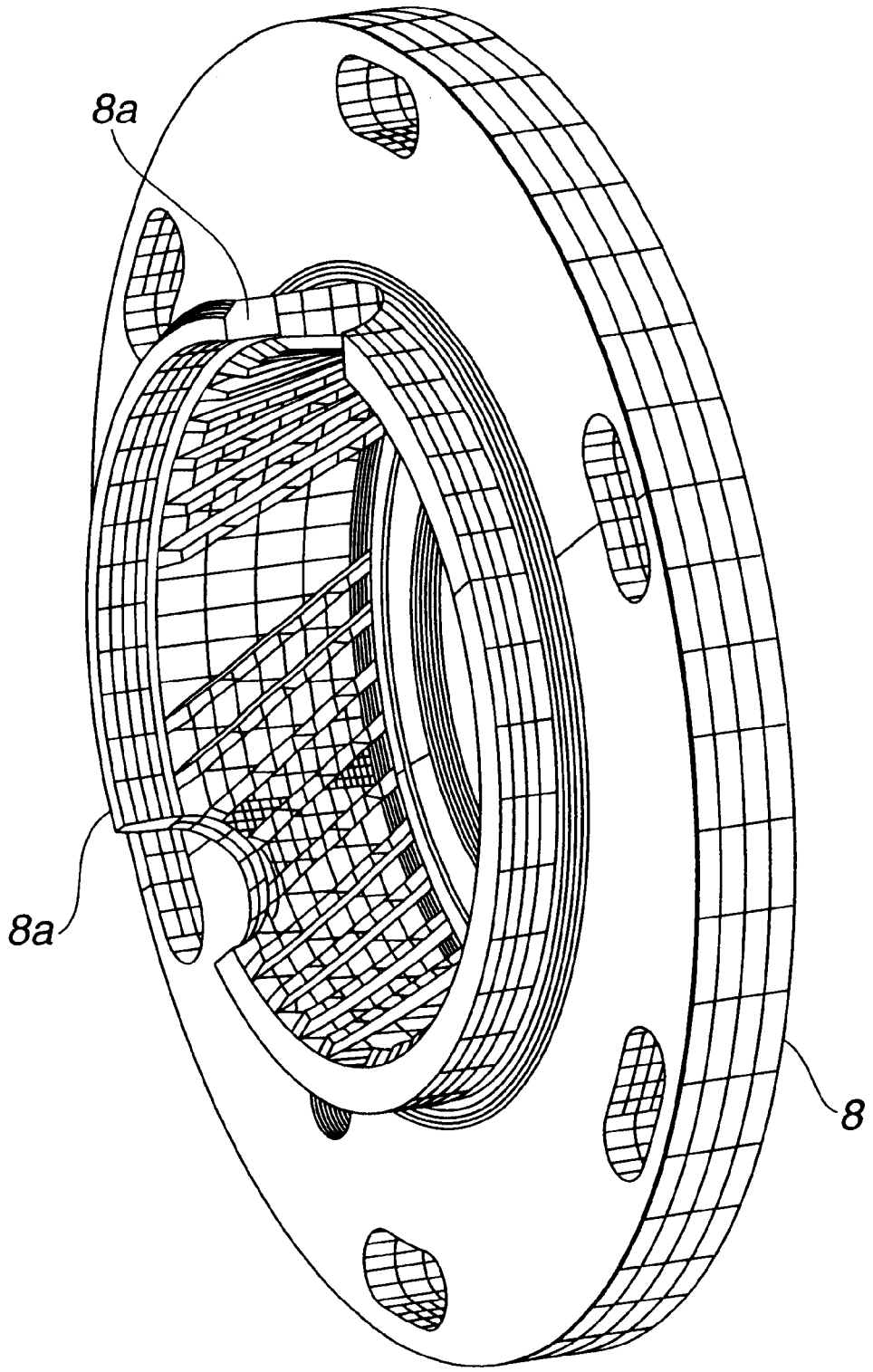
FIG. 3 is a perspective view showing a stopper portion of the VTC system of FIG. 1A.

A cylindrical drum 6 having a flanged portion 6*a* is coaxially arranged with camshaft 1. A return spring 7 is disposed between sprocket 5 and drum 6 so as to permanently bias the drum in a direction that a rotational or angular phase of the drum advances in case of application of the VTC to the intake valve (retards in case of application of the VTC to the exhaust valve). In the shown embodiment, a coiled spring is used as return spring 7. As clearly seen in FIG. 2, an outer casing (simply, a case) 8 containing an axially-extending, substantially cylindrical portion is integrally connected to or integrally formed with sprocket 5. One end (the right-hand end in FIG. 2) of return spring 7 is fixedly connected to and seated on case 8, whereas the other end of return spring 7 is fixedly connected to and seated on the flanged portion 6*a* of drum 6. A pair of stopper portions 6*b* and 8*a* is provided at axially opposing ends of drum 6 and case 8. Stopper portions 6 band 8*a* are opposed to each other in the rotational direction in a manner so as to restrict a relative displacement of one of drum 6 and case 8 to the other. The detailed shape of stopper portion 8*a* formed at case 8 is shown in FIG. 3. For input motion transmission, an external toothed portion 2*a* is formed on the outer periphery of motion transmission member 2, while an internal toothed portion 9*a* is formed on the inner periphery of a cylindrical slider or piston member 9. In the shown embodiment, external toothed portion 2*a* and internal toothed portion 9*a* are comprised of helical gears in meshed-engagement with each other. That is, external and internal toothed portions or meshing helical gears 2*a* and 9*a* construct a first helical gear mechanism or first helical mechanism (2*a*, 9*a*). In addition to the above, a male-screw threaded portion 9*b*, whose number of thread is three or more, is formed on the outer peripheral wall surface of the left end of piston member 9, while a female-screw threaded portion 6*c*, whose number of thread is three or more, is formed on the inner peripheral wall surface of drum 6. Screw threaded portions 9*b* and 6*c* are threaded and engaged with each other so as to make one of these threaded members rotate without translating and the other to translate without rotating. Additionally, an external toothed portion 9*c* is formed on the outer peripheral wall surface of the right-hand half of piston member 9, while an internal toothed portion 8*b* is formed on the inner peripheral wall surface of case 8. In the shown embodiment, external toothed portion 9*c* and internal toothed portion 8*b* are comprised of helical gears in meshed-engagement with each other. That is, external and internal toothed portions or meshing helical gears 9*c* and 8*b* construct a second helical gear mechanism or second helical mechanism (9*c*, 8*b*).

As can be seen from the cross-section of FIG. 1A, a drum bearing member 10 is interleaved between the outer peripheral wall surface of motion transmission member 2 and the inner peripheral wall surface of drum 6, so as to permit relative rotation of one of motion transmission member 2 and drum 6 to the other. In order to restrict axial movement of the outer peripheral portion of drum bearing member 10, a retaining ring member 11 such as a C-type retaining ring or an E-type snap ring is fitted onto the inner periphery of drum 6, and elastically deformed, put in place, and allowed to snap back toward its unstressed position into a groove formed in the inner periphery of the drum. In order to restrict axial movement of the inner peripheral portion of drum bearing member 10, a bearing locknut 12 is axially threaded and engaged on the outer periphery of the left-hand end of motion transmission member 8.

As can be appreciated from the left-hand side of FIGS. 1A and 2, an electromagnetic brake 13 is located in close proximity to the leftmost end face of drum 6 and fixedly installed on a body of the engine. Electromagnetic brake 13 is comprised of a clutch member 13*b* that is faced on the opposing side with a friction material 13*a*. The opposing side of clutch member 13*b* is opposite to the leftmost end face of drum 6 (see FIG. 2). When the electromagnetic brake is energized, clutch member 13*b* faced with frictional material 13*a* is forced into frictional-contact with the left-hand end face of the flanged portion 6*a* of drum 6.

The fundamental operation of the VTC system is hereinafter described in detail.

When electromagnetic brake 13 is de-energized, that is, a control signal is an OFF signal or a control current value or drive current value is "0", by way of the spring bias of return spring 7 drum 6 is kept at a spring-loaded position that the relative displacement of one of drum 6 and case 8 to the other is restricted by way of abutment of one of the stopper pair (6*b*, 8*a*) with the other. With the drum kept at the spring-loaded position, camshaft 1 is held at a reference position or an initial position that corresponds to a maximum phase-retard position of the camshaft relative to the crankshaft. When controlling or bringing the actual valve timing for the intake valve closer to a target valve timing by phase-advancing relatively the angular phase of camshaft 1 by a target angle from the maximum phase-retard position (serving as a reference position or an initial position), first, electromagnetic brake 13 is energized or excited and thus clutch member 13*b* is forced into frictional-contact with the left-hand end face of flanged portion 6*a* of drum 6. The friction braking action initiates. Owing to the friction braking action, rotation of drum 6 begins to retard relatively to input rotation of sprocket 5 that is driven in synchronization with rotation of the crankshaft. As a result of this, by way of the threaded-engagement pair (9*b*, 6*c*), piston member 9 moves in one axial direction (in the rightward axial direction in FIG. 2). In order to convert or transfer the axial motion of piston member 9 via the first and second helical mechanisms (2*a*, 9*a*; 9*c*, 8*b*) into the relative rotation of camshaft 1 to the crankshaft, a direction of the tooth trace of piston-member internal helical gear 9*a* that is in meshed-engagement with motion-transmission-member external helical gear 2*a* is inverted with respect to a direction of the tooth trace of piston-member external helical gear 9*c* that is in meshed-engagement with case internal helical gear 8*b*. In other words, the twisted direction of piston-member external helical gear 9*c* is different from that of piston-member internal helical gear 9*a*. That is, piston-member external helical gear 9*c* is an inverse helical gear with regard to piston-member internal helical gear 9*a*. Therefore, when piston member 9 shifts or moves in the one axial direction (in the rightward axial direction in FIG. 2), motion transmission member 2 rotates in its phase-advance direction relative to case 8. As a consequence, camshaft 1 rotates in the phase-advance direction relative to crankshaft whose rotation is synchronized with rotation of sprocket 5. In the shown embodiment, two helical gear mechanisms, namely first helical mechanism (9*a*, 2*a*) provided on the inner peripheral side of piston member 9 and second helical mechanism (9*c*, 8*b*) provided on the outer peripheral side of piston member 9 are used. In lieu thereof, one of these helical gear mechanisms may be constructed as a spur gear mechanism or spline mechanism composed of internal and external splines, each tooth trace being parallel to the axis of camshaft 1. From the viewpoint of a more efficient conversion of axial motion of piston member 9 into relative rotation (phase change) of camshaft 1 to the crankshaft, it is preferable that the motion transmission mechanism is comprised of the above-mentioned two helical mechanisms (2*a*, 9*a*; 9*c*, 8*b*). The angular phase of camshaft 1 is further changed in the phase-advance direction, as the magnitude of the braking force (the sliding friction force) acting against the spring bias of return spring 7 increases due to an increase in the control current value. As appreciated, the amount of retardation of rotation of drum 6 relative to input rotation of sprocket 5 is dependent upon the magnitude of the friction braking force created by electromagnetic brake 13. Due to the above-mentioned retardation of rotation of drum 6 relative to input rotation of sprocket 5, the angular phase of camshaft 1 can be changed relatively to sprocket 5 (the engine crankshaft). The magnitude of the friction braking force created by electromagnetic brake 13, in other words, the control current value applied to electromagnetic brake 13, is generally adjusted or controlled by way of duty-cycle control or duty-ratio control. In the shown embodiment, the degree of the phase change of rotation of drum 6 relative to input rotation of sprocket 5, that is, the amount of timing change of the engine valve (or the amount of timing advance in case of application of the VTC to the intake valve) can be controlled continuously.

As can be seen from the rightmost end of FIG. 1A and FIG. 1B, a cam sensor or a camshaft sensor (exactly, a camshaft position sensor) 21 is provided in close proximity to the outer periphery of a toothed section of camshaft 1. Circumferentially equidistant spaced protruding toothed portions (1*b*, 1*b*, 1*b*) are integrally formed with camshaft 1 or a rotating member fixedly connected to camshaft 1. The number of protruding toothed portions (1*b*, 1*b*, 1*b*) corresponds to the number of engine cylinders. For instance, on V-6 DOHC engines, each of two camshafts (1, 1) of each bank is formed with three circumferentially 120°-equidistant spaced protruding toothed portions (1*b*, 1*b*, 1*b*). A change in a magnetic field occurs owing to a change in an air gap resulting from the rotating protruding toothed portions (1*b*, 1*b*, 1*b*). Cam sensor 21 operates on a Hall-effect principle. Cam sensor 21 cooperates with protruding toothed portions (1*b*, 1*b*, 1*b*), to detect an actual angular phase of camshaft 1. The cam sensor signal is relayed to or an engine control unit (ECU) or an engine control module (ECM) 22 also serving as an electronic VTC controller. Electronic control module 22 operates to electronically control an intake valve timing and/or an exhaust valve timing by adjusting the signal value of the control signal output from its output interface to electromagnetic brake 13. ECM 22 (VTC controller) generally comprises a microcomputer. ECM 22 includes an input/output interface (I/O), memories (RAM, ROM), and a microprocessor or a central processing unit (CPU). The input/output interface (I/O) of ECM 22 receives input information from various engine/vehicle sensors, namely cam sensor 21, an airflow meter 23, a crank angle sensor (or a crankshaft position sensor) 24, and an engine temperature sensor 25. Airflow meter 23 is located in an intake system to detect or measure the quantity of air flowing into engine cylinders. Crank angle sensor 24 is provided to inform ECM 22 of the engine speed as well as the relative position (angular phase) of the crankshaft. In the embodiment, a coolant temperature sensor is used as engine temperature sensor 25. The coolant temperature sensor is screwed into one of coolant passages to sense or detect the actual operating temperature of the engine. Within the ECM, the central processing unit (CPU) allows the access by the I/O interface of input informational data signals from the above-mentioned engine/vehicle sensors 21, 23, 24, and 25. The CPU of ECM 22 is responsible for carrying the engine control program (containing the VTC system control program) stored in memories and is capable of performing necessary arithmetic and logic operations containing an intake-valve timing control processing and/or an exhaust-valve timing control processing (containing an electromagnetic-brake control-current control related to FIGS. 4 and 5). Computational results (arithmetic calculation results), that is, a calculated output signal (electromagnetic brake drive current) is relayed via the output interface circuitry of ECM 22 to electromagnetic brake 13. Actually, the CPU of ECM 22 sets or determines a target intake valve timing or a target intake-valve camshaft angular phase (and/or a target exhaust valve timing or a target exhaust-valve camshaft angular phase) depending upon engine operating conditions (engine speed, engine load, and engine temperature) estimated based on sensor signals from the previously discussed engine/vehicle sensors 21, 23, 24, and 25. In order to attain the target intake-valve camshaft angular phase (or the target exhaust-valve camshaft angular phase), ECM 22 functions to control the control current (drive current) applied to electromagnetic brake 13, checking sensor signals from cam sensor 21 and crank angle sensor 24, so that the actual angular phase of camshaft 1 is brought closer to the target angular phase. As hereunder discussed in reference to the flow charts of FIGS. 4 and 5, according to the control apparatus of the embodiment, a so-called "soft-landing" control is made when electromagnetic brake 13 is switched to an OFF state (a de-energized state) and then the angular phase of camshaft 1 is returned to the initial position (corresponding to the maximum phase-retard position in case of application of the VTC to the intake valve and corresponding to the maximum phase-advance position in case of application of the VTC to the exhaust valve). The "soft-landing" control is effective to reduce noises by way of properly controlled abutment between the stopper portions (6*b*, 8*a*) at a controlled speed (a comparatively slow speed).

Figure 4:
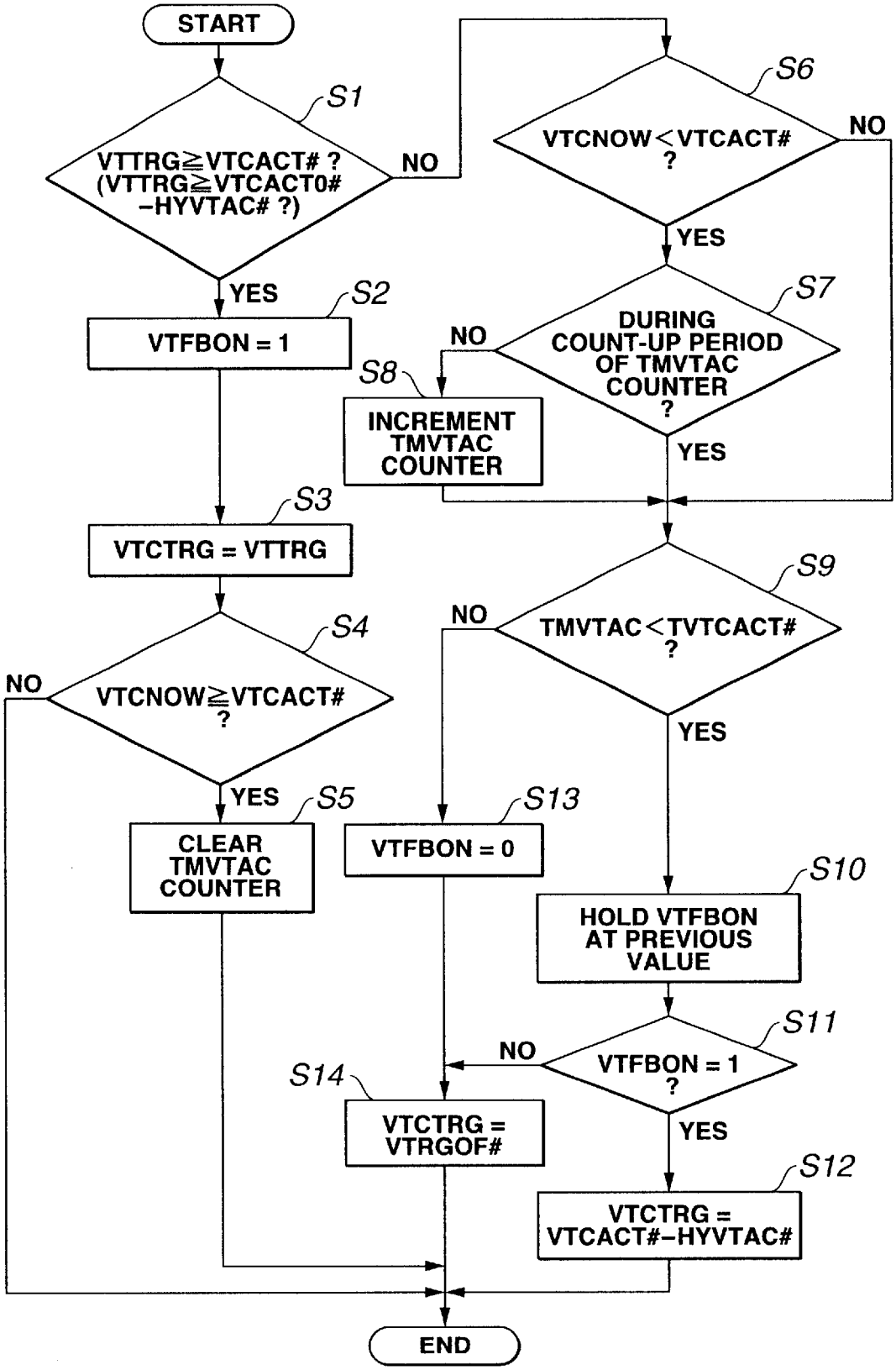
FIG. 4 is a flow chart showing a main control routine executed by the VTC controller of the embodiment.

Referring now to FIG. 4, there is shown the main control routine ("soft-landing" revertive control routine) executed by the processor of ECM 22 as time-triggered interrupt routines to be triggered every predetermined intervals for example 10 msec. In the flow charts, the relative position (the angular phase) of camshaft 1 relative to sprocket 5 (the crankshaft), actually detected or monitored by cam sensor 21 and crank angle sensor 23, is referred to as an "actual phase angle (simply, actual angle) of the variable valve timing system (VTC)" and denoted by VTCNOW. On the other hand, the target relative position (the target angular phase) of camshaft 1 relative to sprocket 5 (the crankshaft), estimated or calculated by ECM 22 depending on the engine operating conditions, is referred to as a "target phase angle (simply, target angle) of the variable valve timing system (VTC)" and denoted by VTCTRG.

At step S1, a basic target angle VTTRG of the VTC is calculated or map-retrieved based on the engine operating conditions (including at least engine speed and engine load) from a predetermined or preprogrammed engine-operating-conditions versus basic-target-angle characteristic map. Additionally, at step S1, a check is made to determine whether basic target angle VTTRG is greater than or equal to a predetermined position VTCACT# (exactly, a phase angle, such as 6° crankangle, corresponding to the predetermined position). Predetermined position VTCACT# (e.g., 6° CA) is set or determined at a position that is advanced slightly from the initial position (the maximum phase-retard position of the VTC) at which the stopper portions 6*b* and 8*a* are in abutted-engagement with each other. Note that predetermined position VTCACT# (e.g., 6° CA) serves as a switching point of the VTC system operating mode from one of a feed-back control mode and a feed-forward control mode to the other. To enhance the accuracy of the VTC system control, actually, taking into account a hysteresis HYVTAC#, the aforementioned basic target angle VTTRG is compared to the difference (VTCACT0#−HYVTAC#) between a predetermined position VTCACT0# and hysteresis HYVTAC#. ECM 22 determines that the condition defined by the inequality VTTRG≧VTCACT# (i.e., VTTRG≧VTCACT0#−HYVTAC#) is unsatisfied when basic target angle VTTRG is less than the difference (VTCACT0#−HYVTAC#) between predetermined position VTCACT0# and hysteresis HYVTAC# during a revertive control that electromagnetic brake 13 is de-energized and thus basic target angle VTTRG of the VTC is gradually decreasing. That is, in case of VTTRG<VTCACT# (i.e., VTTRG<VTCACT0#−HYVTAC#), the routine proceeds from step S1 to step S6. Conversely when basic target angle VTTRG increases and the predetermined position denoted by VTCACT# is reached, that is, in case of VTTRG≧VTCACT# (i.e., VTTRG≧VTCACT0#−HYVTAC#), the routine proceeds from step S1 to step S2.

At step S2, a VTC feedback control enabling flag VTFBON is set at "1".

At step S3, basic target angle VTTRG is set as the target angle (a final target angle) VTCTRG. In other words, target angle (final target angle) VTCTRG is updated by basic target angle VTTRG.

At step S4, a check is made to determine whether the relative angular phase of camshaft 1 (the actual angle of the VTC) VTCNOW is greater than or equal to predetermined position VTCACT# (e.g., 6° CA). In determining or setting the predetermined position VTCACT#, the control hunting (an overshoot and/or an undershoot) of the VTC system is taken into account. In other words, predetermined angle VTCACT# is experimentally determined depending on the convergence performance of actual angle VTCNOW toward target angle VTCTRG. From results of experiment assured by the inventors of the present invention, the worst values of control hunting (an overshoot and an undershoot) were ±6-degree crankangle. The previously-noted predetermined position VTCACT# is determined or set at a reasonable angular value such as 6-degree CA, in such a manner as to avoid the collision-contact with the VTC maximum phase-retard position stopper (6*b*, 8*a*) even when the worst undershoot occurs.

When the answer to step S4 is in the affirmative (YES), i.e., in case of VTCNOW≧VTCACT#, step S5 occurs. That is to say, in case of VTTRG≧VTCACT# and VTCNOW≧VTCACT#, in other words, when target angle VTCTRG and actual angle VTCNOW both exceed the phase angle corresponding to predetermined position VTCACT# and thus the control system is out of the "soft-landing" revertive control, the routine proceeds from step S4 to step S5.

At step S5, an execution time counter TMVTAC is cleared to "0".

In contrast, when basic target angle VTTRG reduces and becomes less than predetermined position VTCACT#, the routine proceeds to step S6. At step S6, a check is made to determine whether actual angle VTCNOW is less than predetermined position VTCACT#. When the answer to step S6 is in the negative (NO), that is, in case of VTCNOW≧VTCACT#, the routine flows from step S6 to step S9. As detailed later, the answer to step S9 and the answer to step S11 are both affirmative (YES) during the revertive control that electromagnetic brake 13 is de-energized and thus basic target angle VTTRG is gradually decreasing, the feedback control is continuously executed, while setting predetermined position VTCACT# as target angle VTCTRG.

Conversely when the answer to step S6 is in the affirmative (YES), that is, in case of VTCNOW<VTCACT#, the routine proceeds from step S6 to step S7. At step S7, a check is made to determine whether the execution time counter TMVTAC is incrementing or counting up. At the first execution cycle just after the condition of step S6 (defined by VTCNOW<VTCACT#) has been satisfied, a count value of counter TMVTAC is not yet incremented. At this time, the routine proceeds from step S7 to step S8. At step S8, the count value of counter TMVTAC is incremented, so as to initiate the count-up operation of TMVTAC. From the next execution cycle, the routine jumps step 7 and thus flows from step S6 to step S9. The counter TMVTAC is incremented from a state wherein the count value is cleared via step S5.

At step S9, a check is made to determine whether the count value of counter TMVTAC reaches a set value or a predetermined time period or a predetermined target feedback control execution time) TVTCACT# such as 50 milliseconds. Predetermined target control execution time is experimentally determined, taking into account the control performance of the VTC system, for example a convergent time of actual angle VTCNOW with respect to target angle VTCTRG. The flow from step S9 to step S10 is repeatedly executed during a time period that the count value of counter TMVTAC is less than set value (target control execution time) TVTCACT#, that is, until the count value of counter TMVTAC reaches target control execution time TVTCACT#. At step S10, VTC feedback control enabling flag VTFBON is held at the previous value.

After step S10, step S11 occurs. At step S11, a check is made to determine whether VTC feedback control enabling flag VTFBON is set (=1) or reset (=0). During the revertive control, VTC feedback control enabling flag VTFBON is set via step S2 and remains unchanged. Therefore, the routine proceeds from step S11 to step S12 during the revertive control. At step S12, the feedback control is continuously executed, while setting predetermined position VTCACT# as target angle VTCTRG.

In contrast when the count value of counter TMVTAC reaches target control execution time TVTCACT# (that is, TMVTAC≧TVTCACT#), in other words, when target control execution time TVTCACT# for the feedback control, which is executed in a manner so as to adjust predetermined position VTCACT# to target angle VTCTRG, is reached, the routine flows from step S9 to step S13.

At step S13, VTC feedback control enabling flag VTFBON is reset at "0", and therefore the feedback control processing terminates.

After step S13, step S14 occurs. At step S14, target angle VTCTRG is switched to an initial position or a maximum phase-retard position (a phase angle corresponding to the initial position) VTRGOF#. At the same time, the system operating mode is switched from the feedback control mode to the feedforward control mode. That is, after the feedback control has been continuously executed for the predetermined feedback control execution time TVTCACT#, the feedforward control initiates so as to optimize there turn to the initial position. As discussed later, according to the feedforward control, actual angle VTCNOW is gradually returned to initial position (maximum phase-retard position) VTRGOF#.

In the event that energization of electromagnetic brake 13 starts and the VTC system is controlled in the phase-advance direction from initial position VTRGOF#, ECM 22 determines that basic target angle VTTRG is still greater than or equal to predetermined position VTCACT# (not yet subtracted by the predetermined hysteresis HYVTAC#). In this case, the feedback control is executed in a manner so as to adjust predetermined position VTCACT# to target angle VTCTRG via steps S2 and S3. In the main VTC control routine of the control apparatus of the embodiment, when step S11 determines that VTC feedback control enabling flag VTFBON is reset (=0), step S14 occurs so as to switch target angle VTCTRG to initial position VTRGOF# and to gradually return actual angle VTCNOW to initial position VTRGOF#. Such a flow (from S1 to S14) is provided, taking into account termination of the feedback control owing to the other control purposes. For instance, due to repetition of slight or momentary depressions of an accelerator pedal, the control objective (i.e., target angle VTCTRG) of the VTC system tends to increase. In such a case, when accelerating the vehicle by depressing the accelerator pedal, there is an increased tendency for the actual acceleration rate to exceed a desired acceleration rate due to the undesirably increased control objective. To avoid this, the flow from step S11 to step S14 is used.

Figure 5:
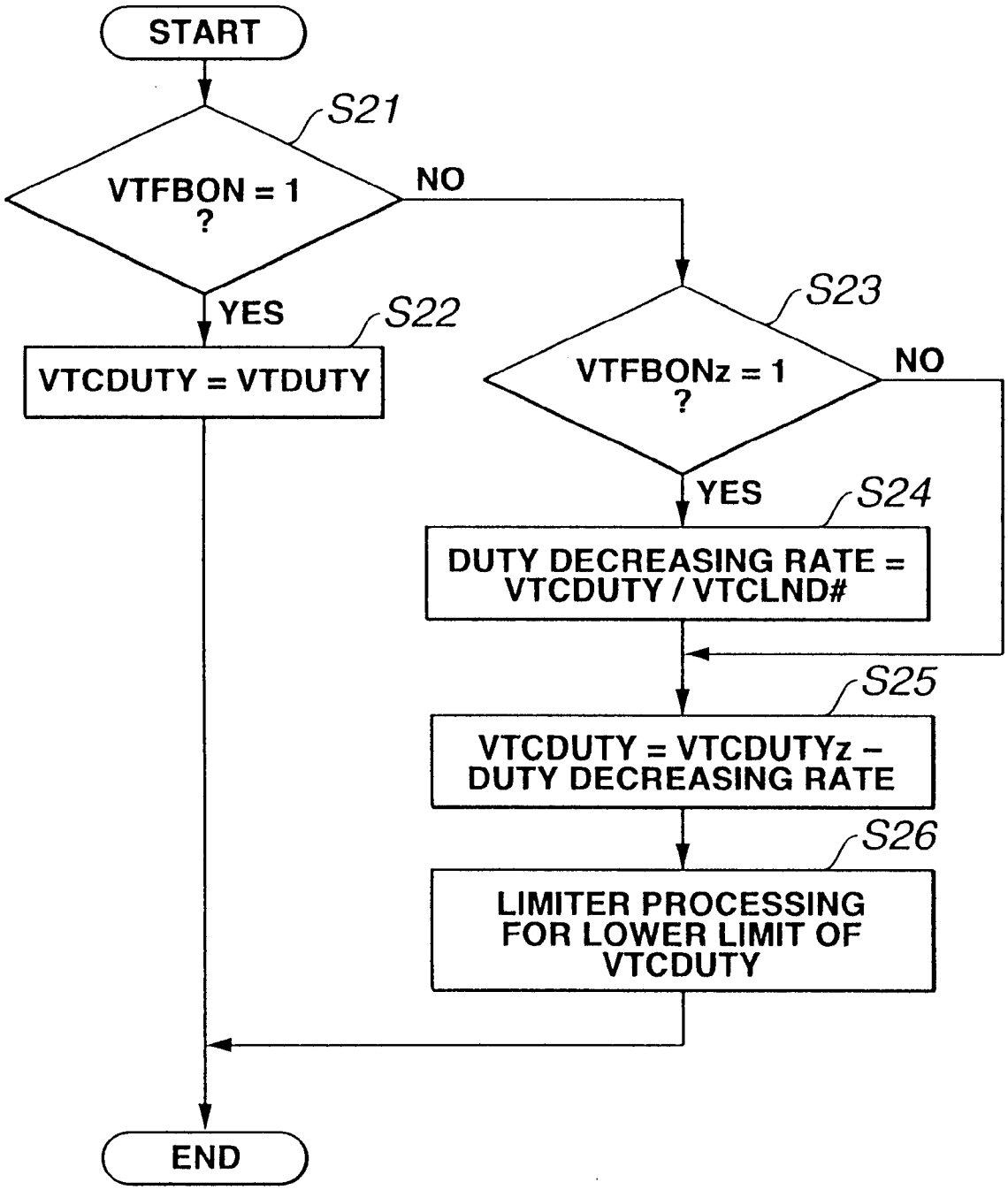
FIG. 5 is a flow chart showing a VTC system duty VTCDUTY setting routine.

Referring now to FIG. 5, there is shown the VTC system duty VTCDUTY setting routine. Briefly, as can be appreciated from two different flows seen in FIG. 5, namely a first flow from step S21 to step S22, and a second flow from step S21 through steps S23–S25 to step S26, the VTC system duty value VTCDUTY is selected or set depending on whether the system operating mode is the VTC feedback control (VTFBON=1) or the VTC feedforward control (VTFBON=0).

At step S21, a check is made to determine whether VTC feedback control enabling flag VTFBON is set (=1) or reset (=0). When the answer to step S21 is affirmative (VTFBON=1), the routine proceeds from step S21 to step S22. At step S22, VTC system duty value VTCDUTY is set at a duty cycle value VTDUTY that corresponds to a control signal of a proportional-plus-integral-plus-derivative control (PID control). The control signal of the PID control is based on the difference between target angle VTCTRG and actual angle VTCNOW and is a linear combination of the difference (the error signal), its integral, and its derivative.

Conversely when the answer to step S21 is negative (VTFBON=0), the routine proceeds from step S21 to step S23. At step S23, a check is made to whether the previous value VTFBONz of VTC feedback control enabling flag VTFBON is set at "1". As can be seen from the flow from step S21 to step S23, ECM determines that the VTC feedback control has been switched from the enabled state to the disabled state, when two conditions VTFBON=0 and VTFBONz=1 are satisfied.

When the answer to step S23 is affirmative (YES), exactly just after switching (VTFBONz=1→VTFBON=0) from the feedback-control enabled state (VTFBONz=1) to the disabled state (VTFBON=0), the procedure flows from step S23 to step S24. At step S24, a duty decreasing rate dVTCDUTY/dt in the VTC system duty VTCDUTY, which corresponds to the duty cycle value of the control signal applied to the electromagnetic brake incorporated in the VTC system, is arithmetically calculated or computed from the following expression.

$$dVTCDUTY/dt=VTCDUTY/VTCLND\#$$

where dVTCDUTY/dt denotes a time rate of change (a time rate of decrease) in VTC system duty VTCDUTY, the current VTC system duty VTCDUTY corresponds to the control-signal duty cycle value established or set via step S22 when the predetermined position VTCACT# has been reached just after termination of the feedback control, and VTCLND# denotes a duty cutoff time or a target time interval from a time when the feedforward control initiates to a time when a current phase-angle position corresponding to actual angle VTCNOW reaches initial position VTRGOF#.

That is, the previously-noted duty decreasing rate dVTCDUTY/dt (the time rate of change in VTC system duty VTCDUTY) is determined so that the VTC system operates at an optimally controlled returning speed that initial position VTRGOF# is reached from the current phase-angle position (corresponding to actual angle VTCNOW) after a lapse of duty cutoff time VTCLND#. The time rate of change (dVTCDUTY/dt) in VTC system duty VTCDUTY is experimentally determined, taking into account noises created when the valve in the VTC system seats, that is, noises created owing to abutment of one of the VTC maximum phase-retard position stopper pair (6*b*, 8*a*) with the other. For instance, the duty decreasing rate may be set as a predetermined time rate of change that the duty cycle value calculated when the feedforward control initiates is gradually reduced to a zero duty (VTCDUTY=0) for a predetermined time (i.e., duty cutoff time VTCLND#) such as 250 milliseconds.

Conversely when the answer to step S23 is negative (NO), the routine proceeds from step S23 to step S25.

At step S25, as appreciated from the following expression, VTC system duty VTCDUTY is arithmetically calculated by subtracting the aforementioned duty decreasing rate dVTCDUTY/dt from the previous value VTCDUTYZ of the duty cycle value of the control signal.

$$VTCDUTY=VTCDUTYZ-dVTCDUTY/dt$$

At step S26, a lower limiter processing is made to the VTC system duty VTCDUTY calculated via step S25, so that a negative value is not set as a final duty cycle value of the control signal. In this manner, a series of VTC system duty VTCDUTY setting procedures terminates.

Figure 6:
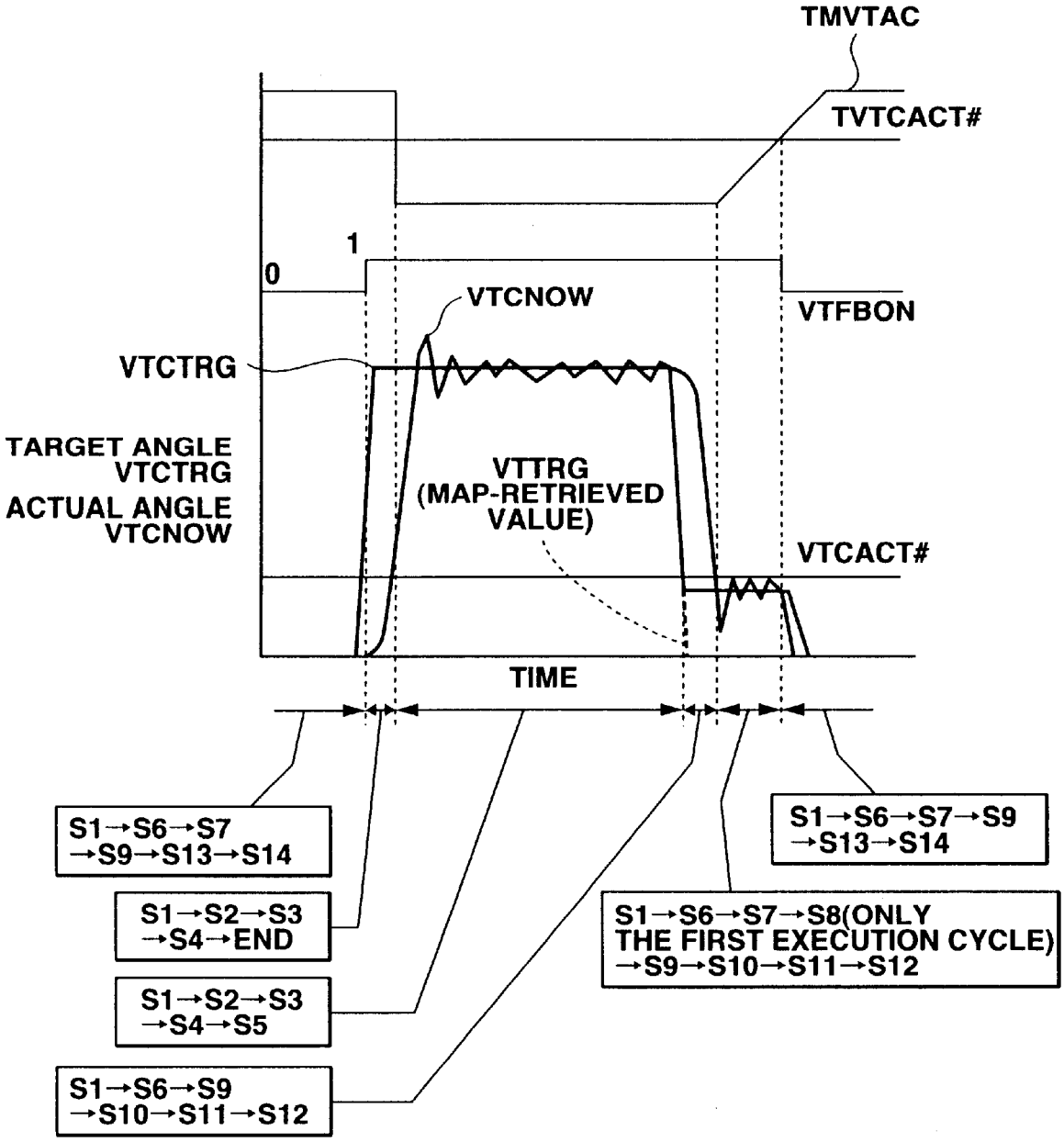
FIG. 6 is a time chart showing a first control pattern of the VTC controller of the embodiment.

Referring now to FIG. 6, there is shown the first control pattern of soft-landing control executed by ECM 22 (the VTC controller) of the embodiment and obtained under a condition that normal acceleration is performed with the actual angle VTCNOW kept at initial position VTRGOF#. In this case, basic target angle VTTRG (i.e., target angle VTCTRG) increases and exceeds predetermined position VTCACT# due to an increase in engine load, i.e., depression of the accelerator pedal, and therefore VTC feedback control enabling flag VTFBON is set to initiate the VTC system feedback control (see the time interval corresponding to the flow defined as S1→S2→S3→S4→END in the time chart of FIG. 6). As soon as the feedback control initiates, actual angle VTCNOW begins to increase in accordance with an increase in target angle VTCTRG with a slight time delay (see the early stage of the time interval corresponding to the flow defined as S1→S2→S3→S4→S5 in the time chart of FIG. 6). Thereafter, by way of the feedback control, actual angle VTCNOW is brought closer to target angle VTCTRG (see the intermediate stage of the time interval corresponding to the flow defined as S1→S2→S3→S4→S5 in the time chart of FIG. 6). Thereafter, the soft-landing revertive control, in which the electromagnetic brake is switched to the de-energized state and then the angular phase of camshaft 1 is returned to initial position VTRGOF#, initiates. At the early stage of soft-landing revertive control, actual angle VTCNOW decreases by way of the feedback control or closed-loop control (see the time interval corresponding to the flow defined as S1→S6→S9→S10→S11→S12 in the time chart of FIG. 6). As soon as actual angle VTCNOW becomes below predetermined angle VTCACT#, the count value of feedback-control execution time counter TMVTAC is incremented from "0" and predetermined position VTCACT# is set as target angle VTCTRG so that actual angle VTCNOW is brought closer to target angle VTCTRG, that is, predetermined angle VTCACT# (see the time interval corresponding to the flow defined as S1→S6→S7→S8 (only the first execution cycle)→S9→S10→S11→S12 in the time chart of FIG. 6). The soft-landing revertive control based on feedback control is continuously executed, while setting predetermined position VTCACT# as target angle VTCTRG, until the count value of feedback-control execution time counter TMVTAC reaches the predetermined target control execution time TVTCACT#. As soon as predetermined target control execution time TVTCACT# has expired, VTC feedback control enabling flag VTFBON is reset in order to terminate the feedback control, and thereafter the soft-landing revertive control based on feedforward control initiates, while setting initial position VTRGOF# as target angle VTCTRG (see the time interval corresponding to the flow defined as S1→S6→S7→S9→S3→S14 in the time chart of FIG. 6 at the last stage of the soft-landing revertive control). As can be appreciated from the first control pattern of FIG. 6, during the soft-landing revertive control based on feedback control, the angular phase of camshaft 1 is temporarily halted at the predetermined position VTCACT#. After the temporary halting operation, the VTC system operating mode is switched from the feedback control to the feedforward control, so as to optimize the soft-landing revertive control.

Figure 7:
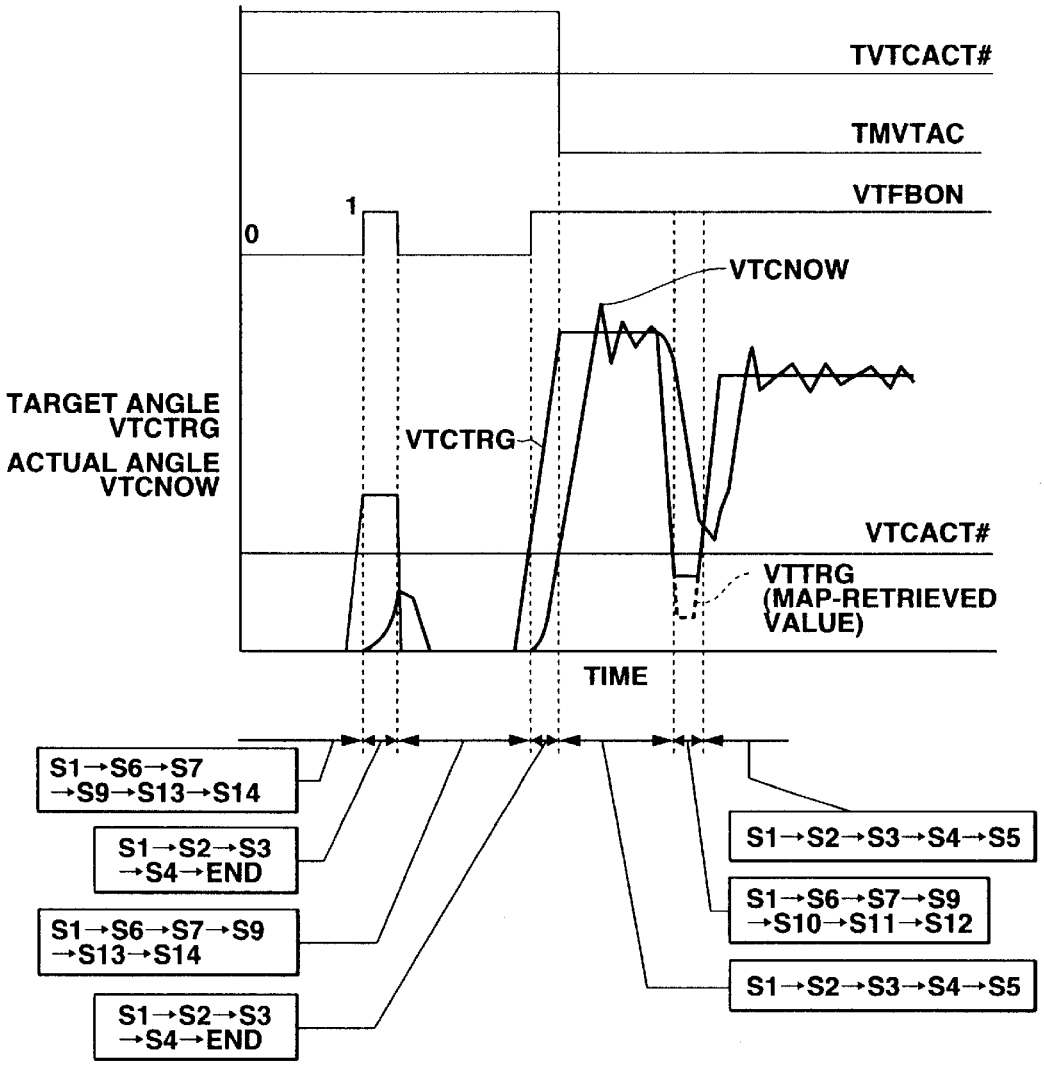
FIG. 7 is a time chart showing a second control pattern of the VTC controller of the embodiment.

Referring now to FIG. 7, there is shown the second control pattern of soft-landing control executed by ECM 22 of the embodiment and obtained under a condition that rapid acceleration is performed after the presence of slight or momentary depression of the accelerator pedal for a brief moment. In this case, target angle VTCTRG temporarily exceeds predetermined position VTCACT# and soon recovers toward predetermined position VTCACT# (see the time interval corresponding to the flow defined as S1→S2→S3→S4→END (the first occurrence) in the time chart of FIG. 7 and the early stage of the time interval corresponding to the flow defined as S1→S6→S7→S9→S13→S14 (the second occurrence) in the time chart of FIG. 7). During the above-mentioned time interval corresponding to the flow defined as S1→S2→S3→S4→END (the first occurrence) in the time chart of FIG. 7, the feedback control is executed. On the other hand, during the early stage of the time interval corresponding to the flow defined as S1→S6→S7→S9→S13→S14 (the second occurrence) in the time chart of FIG. 7, the feedforward control is executed. By way of a combination of the temporary feedback control and feedforward control executed for a brief moment, actual angle VTCNOW returns to initial position VTRGOF# without exceeding predetermined position VTCACT#. Actually, when the accelerator pedal is released at once after the slight or momentary depression, both of target angle VTCTRG and actual angle VTCNOW drop and become less than predetermined position VTCACT#. In such a case, soon, the control flow is switched from the flow indicated by S1→S2→S3→S4→END to the flow S1→S6→S7→S9→S13→S14. After this, depressing and releasing actions of the accelerator pedal are repeated as follows. First, the accelerator pedal is greatly depressed and the vehicle is accelerated rapidly until target angle VTCTRG is remarkably followed up by actual angle VTCNOW by way of the feedback control (see the time interval corresponding to the flow defined as S1→S2→S3→S4→END (the second occurrence) in the time chart of FIG. 7). The feedback control is continuously executed to bring actual angle VTCNOW closer to target angle VTCTRG (see the intermediate stage of the time interval corresponding to the flow defined as S1→S2→S3→S4→S5 (the first occurrence) in the time chart of FIG. 7). Thereafter, at once, the accelerator pedal is released again for a comparatively brief moment. Thus, actual angle VTCNOW begins to rapidly decrease due to a decrease in target angle VTCTRG (see the last stage of the time interval corresponding to the flow defined as S1→S2→S3→S4→S5 (the first occurrence) in the time chart of FIG. 7). After such a brief accelerator-pedal releasing time, the accelerator pedal is greatly re-depressed at once (see the time interval corresponding to the flow defined as S1→S6→S7→S9→S10→S11→S12 in the time chart of FIG. 7). Owing to the brief accelerator-pedal releasing time, actual angle VTCNOW begins to increase again toward target angle VTCTRG by way of the feedback control without feedforward control, before actual angle VTCNOW reaches predetermined position VTCACT# (see the early state of the time interval corresponding to the flow defined as S1→S2→S3→S4→S5 (the second occurrence) in the time chart of FIG. 7).

Figure 8:
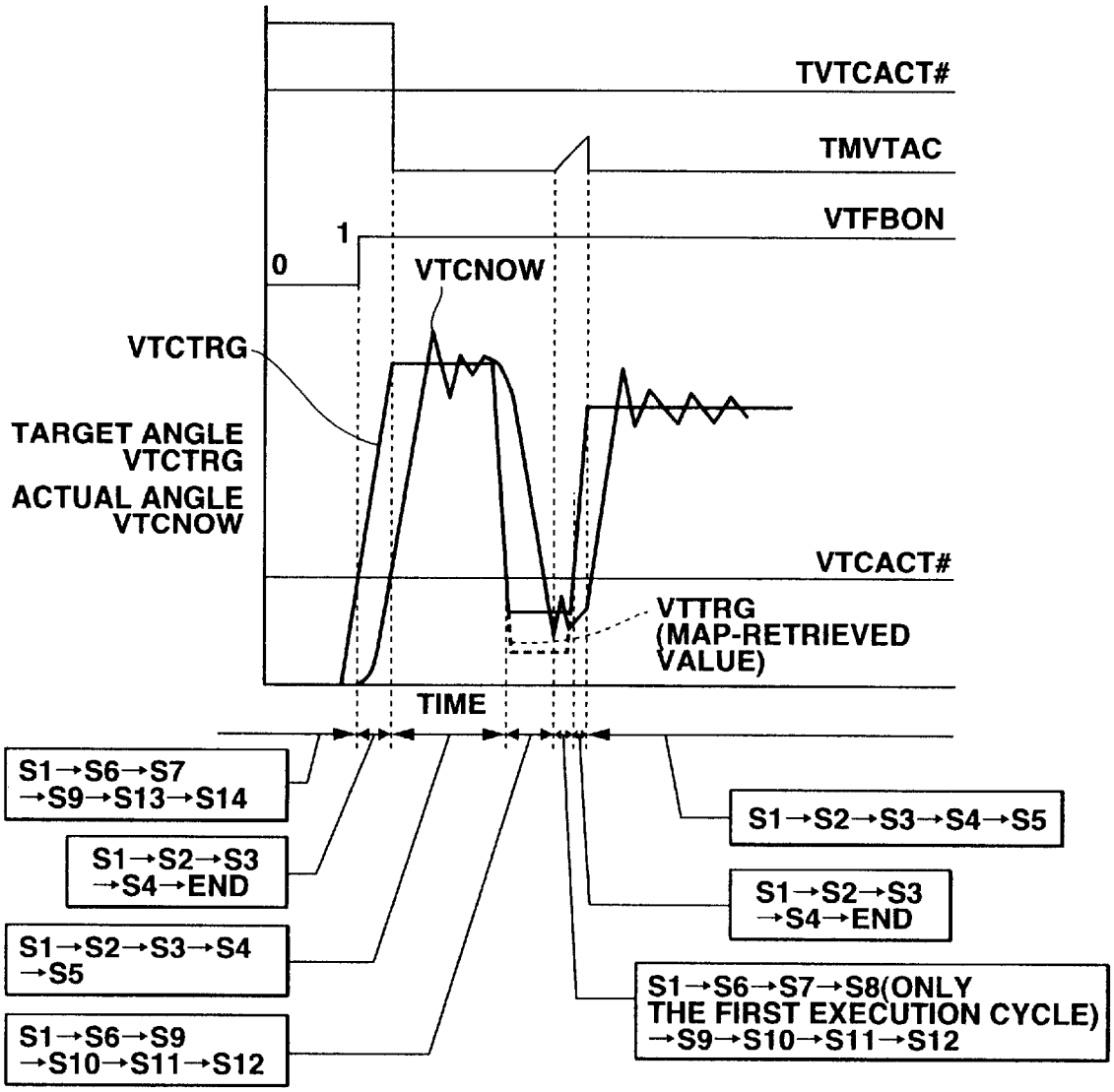
FIG. 8 is a time chart showing a third control pattern of the VTC controller of the embodiment.

Referring now to FIG. 8, there is shown the third control pattern of soft-landing control executed by ECM 22 of the embodiment. The third control pattern shown in FIG. 8 is somewhat similar to the latter half of the second control pattern shown in FIG. 7. However, the accelerator-pedal releasing time of the third control pattern is remarkably longer than that of the second control pattern. As can be appreciated from the comparatively long time interval corresponding to the flow defined as S1→S6→S7→S9→S10→S11→S12 in the time chart of FIG. 8, in case of the third control pattern the accelerator-pedal releasing time is comparatively long. Owing to the long accelerator-pedal releasing time, actual angle VTCNOW as well as target angle VTCTRG reduces to below predetermined position VTCACT#. As soon as actual angle VTCNOW becomes below predetermined angle VTCACT#, the count value of feedback-control execution time counter TMVTAC is incremented from "0" and predetermined position VTCACT# is set as target angle VTCTRG so that actual angle VTCNOW is brought closer to target angle VTCTRG, that is, predetermined angle VTCACT# (see the time interval corresponding to the flow defined as S1→S6→S7→S8 (only the first execution cycle)→S9→S10→S11→S12 in the time chart of FIG. 8). However, in the third control pattern, the accelerator pedal is rapidly re-depressed at once after the accelerator-pedal releasing time has expired. Therefore, actual angle VTCNOW is increasingly compensated for by way of the feedback control executed continuously, before the soft-landing revertive control based on feedback control terminates and the soft-landing revertive control based on feedforward control initiates, that is, before the predetermined target control execution time TVTCACT# expires (see the time interval corresponding to the flow defined as S1→S2→S3→S4→END (the second occurrence) in the time chart of FIG. 8 and the time interval corresponding to the flow defined as S1→S2→S3→S4→S5 (the second occurrence) in the time chart of FIG. 8).

Figures 9A, 9B:
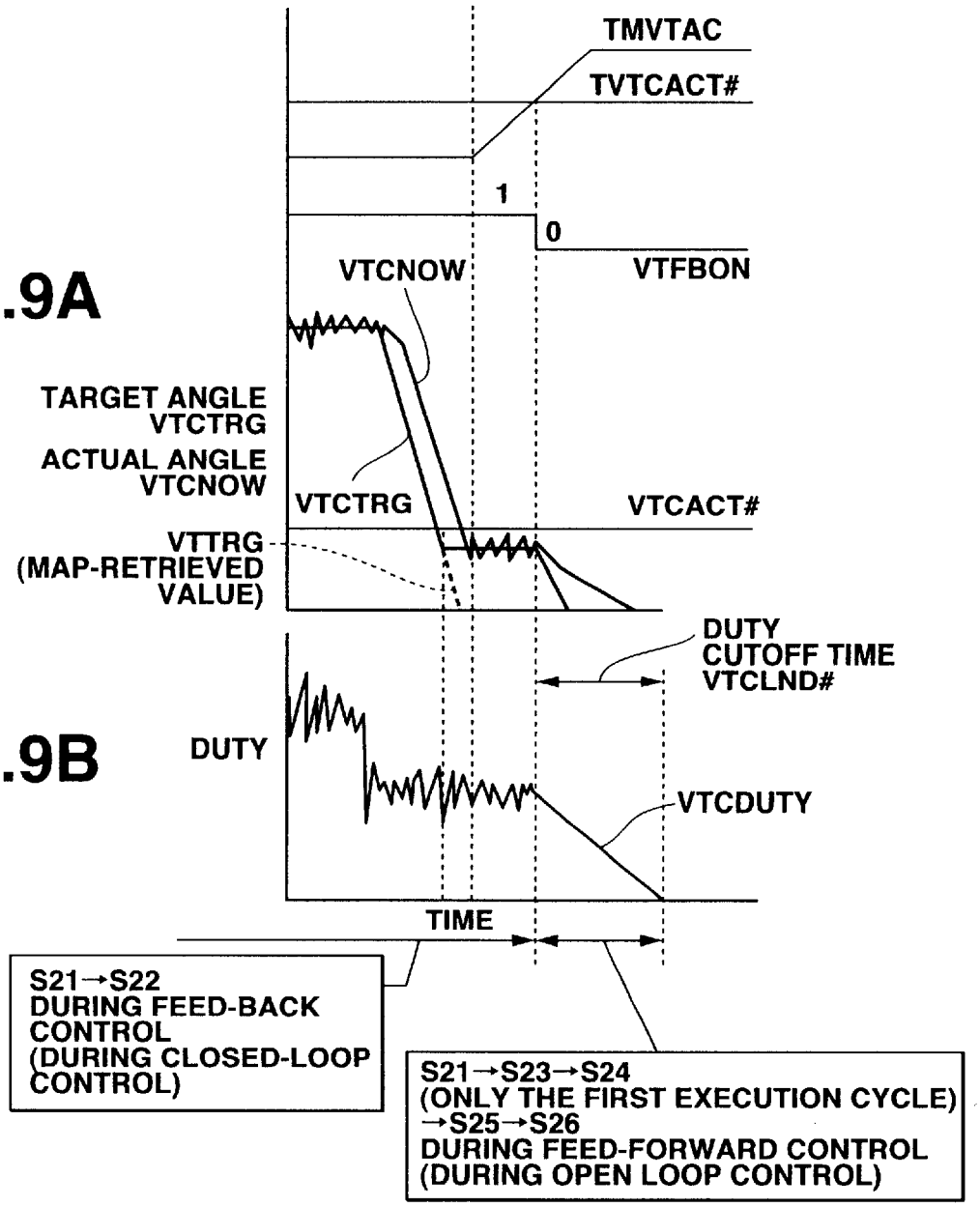
FIGS. 9A and 9B are time charts showing and detailing the relationship between variations in the VTC system duty VTCDUTY and variations in presence of a transition from the soft-landing revertive control based on feedback control to the soft-landing revertive control based on feedforward control.

Referring now to FIGS. 9A and 9B, there are shown the details of the control pattern and variations in VTC system duty VTCDUTY in presence of the transition from the soft-landing revertive control based on feedback control to the soft-landing revertive control based on feedforward control. As can be seen from the signal waveform of the control-signal duty cycle value fluctuating during the time interval corresponding to the flow defined as S21→S22 in the time chart of FIG. 9B, when the soft-landing revertive control initiates from a state that the feedback control is executed so that actual angle VTCNOW is brought closer to target angle VTCTRG above predetermined position VTCACT#, the reversible control based on feedback control is executed continuously for a predetermined time period (predetermined target control execution time TVTCACT#) so that actual angle VTCNOW is maintained at predetermined position VTCACT# for the predetermined time period (predetermined target control execution time TVTCACT#). After this, as can be seen from the signal waveform of the control-signal duty cycle value decreasing in a linear fashion during the time interval corresponding to the flow defined as S21→S23→S24 (only the first execution cycle)→S25→S26 in the time chart of FIG. 9B, the reversible control based on feedforward control initiates. According to the soft-landing reversible control based on feedforward control, the control-signal duty cycle value linearly decreases with a predetermined constant time rate of change, such that the duty cycle value calculated when the feedforward control initiates gradually reduces to a zero duty (VTCDUTY=0) for a predetermined time interval (i.e., duty cutoff time VTCLND#) such as 250 milliseconds.

The entire contents of Japanese Patent Application No. P2001-164191 (filed May 31, 2001) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable valve timing system for an internal combustion engine comprising:

a sensor that detects an angular phase of a camshaft relative to a crankshaft; and an electronic control unit capable of performing a revertive control by which the angular phase of the camshaft is returned to an initial position with a specified control pattern, said electronic control unit comprising a processor programmed to perform the following:

(a) switching an operating mode of the variable valve timing system from a feedback control to a feedforward control at a predetermined position, which is phase-changed by a predetermined phase angle from the initial position, during the revertive control.

2. The variable valve timing system as claimed in claim 1, wherein:

the predetermined position is determined depending on at least one of an overshoot and an undershoot of the angular phase of the camshaft with respect to the predetermined position, during the revertive control.

3. The variable valve timing system as claimed in claim 1, wherein:

the processor is further programmed for:

(b) continuously executing the feedback control for a predetermined time period from a time when the angular phase of the camshaft reaches the predetermined position during the revertive control; and (c) initiating the feedforward control after the feedback control has been continuously executed for the predetermined time period from the time when the predetermined position has been reached, so as to return the angular phase of the camshaft to the initial position with a predetermined time rate of change by way of the feedforward control.

4. The variable valve timing system as claimed in claim 3, wherein:

the predetermined time period, during which the feedback control is continuously executed, is determined depending on a convergent time that an actual angular phase of the camshaft is converged to a target angular phase from the time when the angular phase of the camshaft reaches the predetermined position.

5. The variable valve timing system as claimed in claim 4, wherein:

the predetermined time rate of change is set so that a time interval that the angular phase of the camshaft reaches from the predetermined position to the initial position is fixed to a constant time interval.

6. The variable valve timing system as claimed in claim 1, wherein:

the variable valve timing system comprises an electromagnetic brake that changes the angular phase of the camshaft by way of a friction braking action.

7. A control apparatus of a variable valve timing system for an internal combustion engine, comprising:

a sensor that detects an angular phase of a camshaft relative to a crankshaft;

a return spring that returns the angular phase of the camshaft to an initial position; and an electronic control unit configured to be electronically connected to the variable valve timing system to variably control a valve timing by changing the angular phase of the camshaft against a spring bias of the return spring and execute a revertive control by which the angular phase of the camshaft is returned to the initial position, said electronic control unit comprising a processor programmed to perform the following:

(a) executing a feedback control that temporarily halts the angular phase of the camshaft at a predetermined position, which is phase-changed by a predetermined phase angle from the initial position, during the revertive control; and (b) switching to a feedforward control after the feedback control, so as to return the angular phase of the camshaft to the initial position.

8. The control apparatus as claimed in claim 7, wherein:

the predetermined position is determined depending on at least one of an overshoot and an undershoot of the angular phase of the camshaft with respect to the predetermined position, during the revertive control.

9. The control apparatus as claimed in claim 7, wherein:

the feedback control is switched to the feedforward control after the feedback control has been continuously executed for a predetermined time period from a time when the angular phase of the camshaft reaches the predetermined position.

10. The control apparatus as claimed in claim 9, wherein:

the predetermined time period, during which the feedback control is continuously executed, is determined depending on a convergent time that an actual angular phase of the camshaft is converged to a target angular phase from the time when the angular phase of the camshaft reaches the predetermined position.

11. The control apparatus as claimed in claim 7, wherein:

the feedforward control, executed after the feedback control, comprises a control that the angular phase of the camshaft changes at a predetermined time rate of change.

12. The control apparatus as claimed in claim 11, wherein:

the predetermined time rate of change is set so that a time interval that the angular phase of the camshaft reaches from the predetermined position to the initial position is fixed to a constant time interval.

13. The control apparatus as claimed in claim 7, wherein:

the variable valve timing system comprises an electromagnetic brake that changes the angular phase of the camshaft by way of a friction braking action.

14. A control apparatus of a variable valve timing system for an internal combustion engine, comprising:

a sensing means for detecting an angular phase of a camshaft relative to a crankshaft;

a return spring for returning the angular phase of the camshaft to an initial position; and an electronic control unit configured to be electronically connected to the variable valve timing system to variably control a valve timing by changing the angular phase of the camshaft against a spring bias of the return spring and execute a revertive control by which the angular phase of the camshaft is returned to the initial position, said electronic control unit comprising:

(a) a feedback control means for executing a feedback control that temporarily halts the angular phase of the camshaft at a predetermined position, which is phase-changed by a predetermined phase angle from the initial position, during the revertive control that the angular phase of the camshaft is adjusted toward the predetermined position; and (b) a feedforward control means for initiating a feedforward control after the feedback control, so as to return the angular phase of the camshaft from the predetermined position to the initial position.

15. The control apparatus as claimed in claim 14, wherein:

the feedback control means continuously executes the feedback control for a predetermined time period from a time when the angular phase of the camshaft reaches the predetermined position; and the feedforward control means initiates the feedforward control after the feedback control has been continuously executed for the predetermined time period, and executes the feedforward control so as to return the angular phase of the camshaft to the initial position with a predetermined time rate of change dDUTY/dt.

16. The control apparatus as claimed in claim 15, wherein:

the predetermined time rate of change is calculated from an expression dDUTY/dt=VTCDUTY/VTCLND#, where dDUTY/dt corresponds to the predetermined time rate of change, VTCDUTY corresponds to a difference between the angular phase of the camshaft established when the feedforward control initiates and the angular phase corresponding to the initial position, and VTCLND# corresponds to a constant time interval.

17. A soft-landing revertive control method of returning an actual angular phase of a camshaft relative to a crankshaft to an initial position by controlling the actual angular phase of the camshaft in a variable valve timing system for an internal combustion engine, employing a return spring creating a spring bias acting in a direction that returns the actual angular phase of the camshaft to an initial position and an electromagnetic brake creating an electromagnetic force acting against the spring bias, the method comprises:

de-energizing the electromagnetic brake;

calculating a target angular phase of the camshaft based on engine operating conditions;

comparing the target angular phase to a predetermined position, which is phase-changed by a predetermined phase angle from the initial position;

comparing the actual angular phase to the predetermined position;

executing a feedback control that temporarily halts the actual angular phase of the camshaft at the predetermined position after the target angular phase reaches the predetermined position and the actual angular phase also reaches the predetermined position; and switching an operating mode of the variable valve timing system from the feedback control to a feedforward control after the feedback control has been continuously executed for a predetermined time period from a time when the actual angular phase has reached the predetermined position.

18. The method as claimed in claim 17, wherein:

the predetermined time period, during which the feedback control is continuously executed, is determined depending on a convergent time that the actual angular phase is converged to the target angular phase from the time when the actual angular phase of the camshaft reaches the predetermined position.

19. The method as claimed in claim 18, wherein:

the feedforward control is executed so as to return the actual angular phase of the camshaft to the initial position with a predetermined time rate of change.

20. The method as claimed in claim 19, wherein:

the predetermined time rate of change is set so that a time interval that the actual angular phase of the camshaft reaches from the predetermined position to the initial position is fixed to a constant time interval.

* * * * *